United States Patent [19]

Maurer et al.

[11] Patent Number: 4,858,287

[45] Date of Patent: Aug. 22, 1989

[54] METHOD FOR THE CONTINUOUS SIZING AND STRETCHING OF SYNTHETIC FILAMENT YARNS

[75] Inventors: Peter Maurer, Waldkirch; Jörg Pfister, Freiburg; Wolfgang Sauter, Gundelfingen, all of Fed. Rep. of Germany

[73] Assignee: Rhodia Aktiengesellschaft, Im Breisgau, Fed. Rep. of Germany

[21] Appl. No.: 197,527

[22] Filed: May 23, 1988

[30] Foreign Application Priority Data

Jul. 25, 1987 [DE] Fed. Rep. of Germany ..... 3724751

[51] Int. Cl.[4] ..... D02H 5/02

[52] U.S. Cl. ..... 28/172; 28/180; 28/246

[58] Field of Search ..... 28/172, 180, 181, 246

[56] References Cited

U.S. PATENT DOCUMENTS

| | | | |
|---|---|---|---|
| 3,605,282 | 9/1971 | Wenger | 28/180 X |
| 4,025,993 | 5/1977 | Kuroda | 28/181 |
| 4,458,397 | 7/1984 | Kuroda et al. | 28/181 |
| 4,669,158 | 6/1987 | Ballarati et al. | 28/172 |

FOREIGN PATENT DOCUMENTS

| | | | |
|---|---|---|---|
| 905768 | 3/1987 | Belgium | 28/172 |
| 499422 | 3/1974 | Japan | 28/185 |
| 1502604 | 3/1978 | United Kingdom | 28/180 |
| 2035401 | 6/1980 | United Kingdom | 28/178 |
| 2185913 | 8/1987 | United Kingdom | 28/178 |

*Primary Examiner*—Robert R. Mackey

*Attorney, Agent, or Firm*—Bucknam and Archer

[57] ABSTRACT

The method for the production of partial warps wound on warping beams or sectional beams, or warps of synthetic filament yarns wound on warp beams, which are completely stretched and sized, consists of sizing a group of parallel synthetic thermoplastic filament yarns, the filaments of which are not completely stretched, in a sizing zone, predrying the sized yarns in a heated predrying zone, subjecting the predried sized group of yarn by final drying in a heated final drying zone, and finally winding the dried group of yarns on warping or (sectional) beams, while the filaments of the filament yarns are stretched jointly and simultaneously in the predrying zone. The stretching occurs preferably between rolls (5, 6) assigned to the sizing zone and rolls (10) assigned to the final drying zone. The method may be carried out with conventional, at most slightly modified sizing machines and it furnishes very uniform partial warps or warps. In particular the filaments of the filament yarns are stretched very uniformly. In addition, a twisting or twist-replacement treatment of the filament yarns prior to sizing may be eliminated because warps are obtained, the filament yarns of which have sufficient cohesion for further processing and a high density of their filaments.

3 Claims, 1 Drawing Sheet

METHOD FOR THE CONTINUOUS SIZING AND STRETCHING OF SYNTHETIC FILAMENT YARNS

FIELD OF THE INVENTION

The invention relates to a method for the production of partial warps wound on warping beams or sectional beams or warps of synthetic filament yarns wound on warp beams, which are essentially completely stretched and sized, according to which there is employed as starting material a group of essentially parallel synthetic thermoplastic filament yarns and this group is guided through a sizing zone, which is optionally heated, and is sized there. It is then guided through a heated predrying zone and predried there, thereafter it is guided through a heated final drying zone and subjected to final drying there, and finally it is wound on warping beams or sectional beams or warp beams, respectively.

The term "filament yarn" means a yarn of several filaments. The term "filament" means an endless, continuous, filamentous structure, that is, one of practically unlimited length.

Partial warps wound on warping beams are those which are employed for assembling to a textile warp wound on a textile warp beam.

DESCRIPTION OF THE RELATED ART

A method is known from European patent No. 0,091,549 for producing warp beams or sectional beams of continuous synthetic yarns which are essentially completely stretched and sized and are suitable for use on looms for making cloth. According to this known method the yarns are delivered through a supply creel, are arranged parallel by means of a guideway, and are passed through a tank containing a sizing liquid in which at least one thread cohesion agent is present;

as starting material, continuous thermoplastic yarns are employed in which the threads or filaments are stretched substantially parallel and not completely;

the stretching and sizing are carried out simultaneously or substantially simultaneously, while the yarns are immersed in the tank containing the sizing liquid.

Further, European patent application No. 0,144,617 describes a method for producing warps or partial warps of continuous synthetic, completely stretched yarns wound on warp beams, which are suitable for all types of textiles produced on looms. For this method, as described in European patent application 0,144,617, one uses at least 24 continuous thermoplastic yarns of substantially parallel and partially stretched filaments which are stretched jointly and simultaneously, while they are immersed in a tank containing a thermostatic liquid, such as water, then are subjected to an interlacing treatment by means of an air nozzle, and finally are sized. These known methods, however, have the following disadvantages:

Without costly additional equipment or extensive structural modifications, the currently used devices for the sizing of partial warps or warps, consisting of a size box, predryers and a final dryer, are not suitable either for carrying out the method according to European patent No. 0,091,549 or for carrying out the method according to European patent application No. 0,144,617. Thus, for the use of the method according to European patent No. 0,091,549, a complete stretching system consisting of drive, transmission and stretching rolls must be installed in a common sizing device, namely in the size box. For use of the method according to European patent application No. 0,144,617, a common sizing device requires the attachment of a tank - for the thermostatic liquid - with complete stretching system consisting of drive, transmission and stretching rolls, as well as a unit with air nozzles for interlacing the filaments of each yarn with each other.

In the method according to European Patent No. 0,091,549 as well as in the method according to European Patent Application No. 0,144,617, the stretching zones are comparatively short. Due to this fact, it is possible only with limitations to adjust any irregularities which occur, such as tension fluctuations or filament snarls of the filament yarns supplied as starting material or to cause them to disappear.

Due to the short stretching zones in the known methods discussed hereinabove, it is furthermore possible only to a limited extent to obtain a very uniform stretching of the filaments and thus of the filament yarns.

In the known methods, the yarns must be subjected prior to sizing to a twisting or twist-replacement treatment, because otherwise the cohesion of the filaments, that is the filament bond, and the filament density within each yarn is too small or not sufficient, and this may, due to loose or projecting filaments, lead to difficulties, for example, in weaving or may later affect the visual appearance of the finished fabric.

As twist-replacement treatment, there is used mainly the interlacing or tangling of the filaments with the aid of a fluid nozzle, preferably an air nozzle.

This interlacing with an air nozzle has the following disadvantages:

It leads to a very high noise level, and it is expensive due to the high energy requirement, the latter, incidentally, is also the case of the twisting itself.

SUMMARY OF THE INVENTION

An object of the invention is to provide a method of the initially mentioned type for the production of partial warps wound on warping beams or sectional beams or warps of synthetic filament yarns wound on warp beams, with which partial warps or warps which are satisfactory in quality and in particular uniform in every respect, may be produced cost-efficiently and/or without great expense. Further, it is possible to eliminate the twisting or twist-replacement treatment for the filament yarns before sizing.

According to the invention, the filaments of the filament yarns of the group of starting materials are stretched jointly and simultaneously in the predrying zone or essentially in the predrying zone. The term "essentially in the predrying zone" means in the region between the last rolls assigned to the sizing zone and the rolls assigned to the final drying zone.

According to the invention, a group of substantially parallel synthetic thermoplastic filament yarns is guided inter alia through, if necessary, a heated sizing zone and is sized there. The term "If necessary, a heated sizing zone" means that the sizing zone, in particular the sizing liquid in the box, may be heated or not heated; the term "not heated" means that the sizing liquid is e.g. room temperature.

The invention offers the following advantages:

1. The novel method may be carried out by means of sizing machines currently in use without the need of expensive supplementary devices and/or structural modifications and an increase in size is not necessary, but at most a simple modification of the transmission ratio of the drive of the rolls in the size box;

2. Since the stretching takes place in the predrying zone and since the latter must be relatively long also in the currently used sizing machines for sufficient predrying, irregularities of the filament yarns being fed are easily eliminated. Further, the heat in the predrying zone is utilized also to promote stretching.

3. Furthermore, due to the correspondingly long predrying zone and thus the long stay of the filament yarns in the temperature-controlled surrounding of this zone, the filaments of the filament yarns are stretched very uniformly.

4. When compared with the currently used sizing methods, less heat is needed in the predrying zone, because the stretch energy, introduced by the roll system assigned to the sizing zone, is transformed into heat and is utilized also for the predrying of the sizing film;

5. It is not necessary to subject the filament yarns to a twisting or twist-replacement treatment prior to the sizing, because according to the invention one obtains partial warps or warps the filament yarns of which always exhibit sufficient cohesion for their further processing and a high density of their filaments. The filament yarns are completely closed and contrary to the filament yarns of the warps or partial warps which are produced according to known methods and which have a rather flattened yarn cross section, exhibit a round yarn cross section. Moreover, the filaments of the filament yarns according to the invention run very largely parallel, and their sizing coating and impregnation is practically complete, which means that the filament yarns themselves as well as the filaments are enveloped by the sizing coating virtually completely.

According to the invention, a group of substantially parallel synthetic thermoplastic filament yarns is employed as starting material. The filaments in these yarns may likewise be parallel, but, although this is not necessary, the filaments may alternatively be interlaced or tangled one with the other in spots, for example with the aid of an air nozzle, or they may have been subjected to twisting.

The filament yarns employed within the scope of the invention may, for example, consist of polyesters such as polyethylene terephthalate, polyamides such as polyamide-6 or polyamide-66, polyolefins such as polyethylene or polypropylene, as well as of their mixtures or copolymers. Alternatively, the filament yarns may consist of other synthetic thermoplastic polymers or their modifications.

DETAILED DESCRIPTION

The invention will be illustrated in more detail hereinbelow with reference to the drawing:

Figure 1:
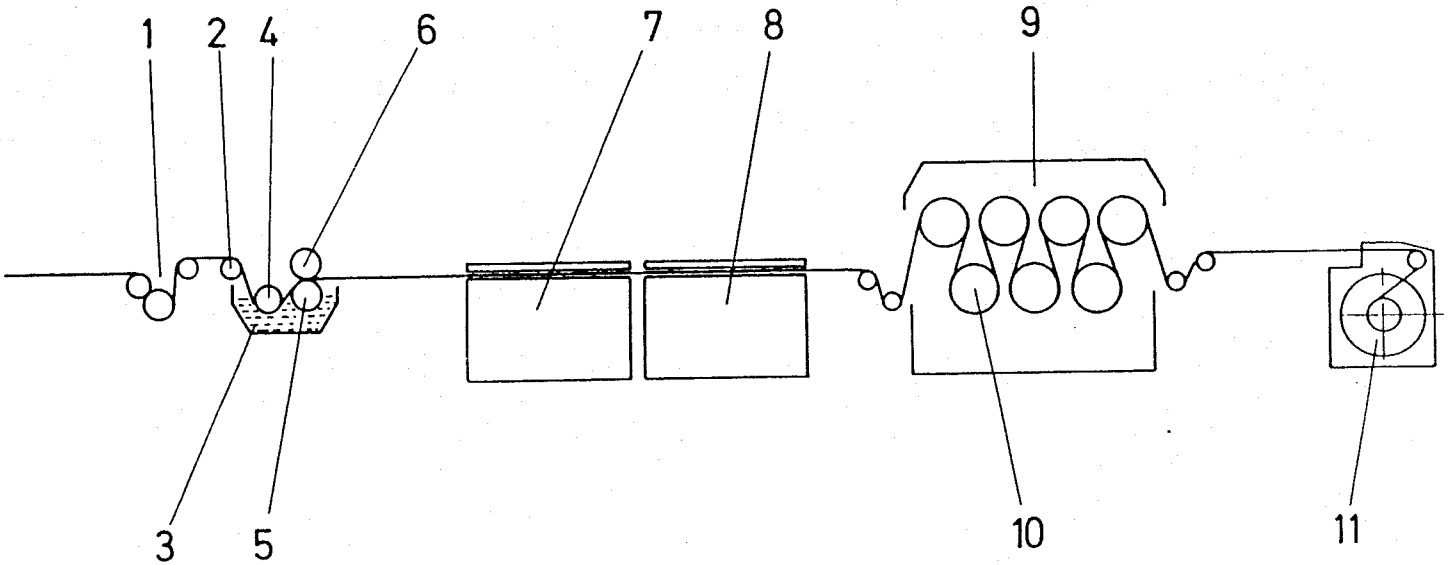
FIG. 1 shows schematically and in section a common apparatus for sizing of partial warps or warps of synthetic filament yarns suitable for carrying out the method according to the invention.

A predetermined number of spools with synthetic thermoplastic filament yarns, the filaments of which are not completely stretched, are placed on a conventional bobbin creel (not shown); from this creel the yarns are drawn under constant tension and are arranged parallel by means of a reed (not shown). Then the group thus formed of filament yarns is guided over a roll system 1 which rotates at constant speed, a roll 2 and then to a size box 3 filled with sizing liquid forming the sizing zone. Then the yarns are guided via an immersion roll 4 through the sizing liquid and are conducted via a sizing roll 5 to the nip between the sizing roll 5 and a squeezing roll 6, where the sizing liquid is applied and the excess is squeezed off at the same time. From the rolls 5 and 6 the yarns are then conducted through heated predryers 7 and 8 forming the predrying zone, where they are predried; then the yarns are guided through a final dryer 9 forming the final drying zone, where they are subjected to final drying by being guided over heated drying cylinders 10. Finally, the parallel filament yarns are led from the final dryer 9 to a warping beam, sectional beam or warp beam 11, on which they are wound.

The rolls 5 and 6 rotate at a circumferential speed which is smaller than that of the drying cylinders 10, whereby the filaments of the filament yarns are stretched jointly and simultaneously, namely between the roll pair 5, 6 and the drying cylinders 10, that is, in the predrying zone, or respectively, essentially in the predrying zone.

The method according to the invention may also be carried out so that the filament yarns are not drawn off directly from spools placed on a creel, but for example from a beam or several beams.

The warps produced according to the method of the invention exhibit excellent running properties in weaving, and the fabrics made from these warps have excellent properties with respect to color affinity, uniformity of color, strength and elongation properties, flattening tendency, and longitudinal contraction.

The invention is further explained with reference to the following examples.

DESCRIPTION OF THE PREFERRED EMBODIMENTS

Example 1

1492 spools with polyamide-66 filament yarn 97.7 dtex f 17 (partially oriented yarn=POY), the filaments of which were therefore preoriented, were placed on a conventional creel (of the company Benninger, Switzerland); the filament cross section was round.

The tensile strength (resistance to tearing) of the filament yarn was 35.2 cN/tex and the rupture elongation 75%.

For this example, a warp sizing machine of the company Tsudakoma, Japan, was employed, in which by a simple exchange of a sprocket wheel pair (change gear pair), the transmission ratio of the drive of the sizing roll assigned to the size box had been modified so that the drying cylinders of the final dryer can rotate at a circumferential speed at least 33% higher than the sizing roll and the squeezing roll.

The yarns were drawn off the creel under constant thread tension with the aid of a draw-off roll system at a speed of 312.2 m/min.

Between the creel and the draw-off roll system were in thread running direction two reeds with eye and one comb, by means of which the yarns were arranged parallel.

The filament yarn group thus formed was led to a size box filled with a sizing liquid.

The sizing liquid consisted of an 11% aqueous solution (bath concentration) of an acrylic sizing composition (Sopronyl AR 41 of Rhone-Poulenc, France) and had a temperature of 42° C.

The yarns were then led over a roll, (immersion roll), dipping into the sizing liquid and were then guided over the sizing roll, also dipping into the sizing liquid, to the nip between this sizing roll and a squeezing roll. The squeezing pressure between the sizing roll and the squeezing roll - when running - was 6.0 kg/cm$^2$ (6.0 daN/cm$^2$). The sizing roll and squeezing roll rotated at a circumferential speed of 312.9 m/min.

Thereafter the parallel yarns were guided through two successive predryers, both having a temperature of 150° C. The predrying zone formed by the two predryers was 11 m long.

Subsequently the group of parallel filament yarns was passed through a final dryer, of which the first drying cylinder rotated at a circumferential speed higher by 31.67% than the circumferential speed of the sizing roll and of the squeezing roll.

By passing over the five heated drying cylinders of the final dryer, the yarns were subjected to final drying. Each of the first four drying cylinders of the final dryer had a temperature of 135° C.; the last drying cylinder of the final dryer had a temperature of 110° C.

The stretching of the filaments of the filament yarns took place in the region between the sizing/squeezing roll and the drying cylinders of the final dryer.

Finally the parallel filament yarns were guided from the final dryer to a warping beam, on which they were wound.

The thread tensions found during execution of the method according to the invention measured on the individual filament yarns were the following:

1. After the thread brake in the creel: 5 cN
2. Before the draw-off rolls: 12 cN
3. In the predrying zone: 70 cN
4. Before winding on the beam: 17 cN The filament yarns thus sized and stretched had the following properties:

Titer: 83.1 dtex (sized)
Tensile strength: 41.5 cN/tex
Rupture elongation: 40%
Boil shrinkage: 7.04%
(30 min in boiling water):
Size application: 4.66%

The filament yarns obtained had an almost round cross section and their filament bond was closed. The core and surface sizing was virtually complete.

Several partial warps thus obtained, wound on warping beams, were joined by assembling to a textile warp wound on a warp beam. The warp exhibited excellent running behavior in weaving.

The fabric produced from this textile warp exhibited very good properties with respect to color affinity, uniformity of color, strength and elongation properties, flattening tendency, and longitudinal contraction; in particular, a very soft feel of the finished fabric could be achieved with this warp.

Example 2

397 spools with polyethylene terephthalate filament yarn 120 dtex f 22 (medium oriented yarn=MOY), the filaments of which were therefore pre-oriented, were placed on a conventional creel (of the company Karl Mayer, Obertshausen, Federal Republic of Germany). The filament cross section was round. The tensile strength of the filament yarn was 43.7 cN/tex and the rupture elongation was 238.3%.

In this example, a warp sizing machine of the company Sucker, Federal Republic of Germany, was employed, in which by simple installation of a change gear into the cardan shaft driving the sizing roll, the transmission ratio of the drive of the sizing roll assigned to the size box had been modified so that the drying cylinders of the final dryer could rotate at a circumferential speed at least 235% higher than the sizing roll and the squeezing roll.

The yarns were drawn off the creel, under constant thread tension, by means of a draw-off roll system at a speed of 45.2 m/min.

One reed with eye and one comb, by means of which the yarns were arranged parallel, were located between the creel and the draw-off roll system, in thread running direction. The filament yarn group thus formed was guided to a size box filled with a sizing liquid.

The sizing liquid consisted of a 20 to 21% aqueous solution (bath concentration) of a polyester size (Gerol PS 25 of the company Rhone-Poulenc, France) and had a temperature of 74° to 77° C.

The yarns were then passed over a roll, (immersion roll), dipping into the sizing liquid and then were passed over the sizing roll lightly touching the surface of the sizing liquid, to the nip between the sizing roll and a squeezing roll. The squeezing pressure between the sizing roll and the squeezing roll, when running, was 600 daN, referred to the total contact line or surface of the two rolls. The sizing roll and the squeezing roll rotated at a circumferential speed of 45.0 m/min.

Then the parallel yarns were guided through two predryers, in sequence, both having a temperature of 120° C. The predrying zone formed by the two predryers was 10 m long.

Subsequently, the group of parallel filament yarns was led through a final dryer, the first drying cylinder of which rotated at a circumferential speed higher by 221.3% than the circumferential speed of the sizing roll and of the squeezing roll. By passing over the five heated drying cylinders of the final dryer, the yarns were subjected to final drying.

The first four drying cylinders of the final dryer had each a temperature of 145° C.; the last drying cylinder of the final dryer had a temperature of 105° C.

The stretching of the filaments of the filament yarns occurred in the region between the sizing/squeezing roll and the drying cylinders of the final dryer.

Finally, the parallel filament yarns were guided from the final dryer to a warping beam, on which they were wound.

The thread tensions determined during execution of the method of the invention, measured on the individual filament yarns, were the following:

1. After the thread brake in the creel: 3.5 cN
2. Before the draw-off rolls: 3 cN
3. In the predrying zone: 38 cN
4. Before winding on the beam: 11 cN The filament yarns thus sized and stretched had the following properties:

Titer: 54.6 dtex (sized)
Final tensile strength: 39.4 cN/tex
Rupture elongation: 29.1%
Boil shrinkage: 3.7%

(30 min in boiling water)
Size application: 5.5%

The filament yarns obtained had an almost round yarn cross section and their filament bond was closed. The core and surface sizing was virtually complete.

Several partial warps thus obtained and wound on warping beams were joined by assembling to a textile warp wound on a warp beam, the warp showing excellent running behavior in weaving. The fabric produced from this warp showed very good properties with respect to color affinity, uniformity of color, strength and elongation properties, flattening tendency and longitudinal contraction.

In Example 1, the starting yarn (polyamide-66 filament yarn 97.7 dtex f 17) - prior to being employed for the method according to the invention - had been subjected only to a very light substitute twisting treatment by means of an air nozzle for interlacing or tangling the filaments and had only 1 to 2 per meter interlacing points, tangle points or fixed points, as described in German patent No. 16 60 267.

In Example 2, the starting yarn, polyethylene terephthalate filament yarn 120 dtex f 22, had not been subjected to any twisting or twist-replacement treatment.

What we claim is:

1. A method for the production of warps wound on beams of synthetic filament yarns which are selected from the group consisting of polyesters, polyamides, polyolefin filament yarns, mixtures thereof and copolymers thereof which are essentially completely and uniformly stretched and sized, of sufficient cohesion for further processing and of a high density, which consists essentially of:

(A) preparing a group of essentially parallel synthetic filament yarns;

(B) guiding said group through a sizing zone whereby said group of yarns is sized;

(C) guiding said sized group of yarns through a heated predrying zone of a plurality of predryers whereby said group of yarns is predried and said predrying zone is at least 10 meters long;

(D) guiding said predried group of sized yarns through a heated final drying zone whereby said group of yarns is finally dried and (E) then winding said dried group of yarns on beams wherein the filaments of the filament yarns of the group of the filament yarns in step (A) are not completely stretched and these filaments are stretched jointly and simultaneously in the prdrying zone by a roll system assigned to the sizing zone and a roll system assigned to the final drying zone and wherein these roll systems rotate at different circumferential speeds and the roll system assigned to the final drying zone rotates at a speed at least 33% higher than the speed of the roll system assigned to the sizing zone.

2. The method according to claim 1 wherein said sizing zone in step B is heated.

3. The method according to claim 1 wherein the polyester filament yarns are polyethylene terephthalate filament yarns; the polyamide filament yarns are polyamide-6 or polyamide-66 filament yarns; and the polyolefin filament yarns are polyethylene or polypropylene filament yarns.

* * * * *